US012667880B2

(12) United States Patent
Ishitobi et al.

(10) Patent No.: US 12,667,880 B2
(45) Date of Patent: Jun. 30, 2026

(54) METHOD AND APPARATUS FOR MANUFACTURING ALUMINUM ALLOY EXTRUDED PART

(71) Applicant: Kabushiki Kaisha Kobe Seiko Sho (Kobe Steel, Ltd.), Kobe (JP)

(72) Inventors: Hideki Ishitobi, Kobe (JP); Kazuhiro Kaida, Shimonoseki (JP); Hiroaki Hosoi, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 556 days.

(21) Appl. No.: 18/042,562

(22) PCT Filed: Aug. 3, 2021

(86) PCT No.: PCT/JP2021/028775

§ 371 (c)(1),
(2) Date: Feb. 22, 2023

(87) PCT Pub. No.: WO2022/049969

PCT Pub. Date: Mar. 10, 2022

(65) Prior Publication Data

US 2023/0321703 A1 Oct. 12, 2023

(30) Foreign Application Priority Data

Sep. 3, 2020 (JP) ..... 2020-148473

(51) Int. Cl.

| | |
|---|---|
| ***B21C 23/00*** | (2006.01) |
| ***B21C 23/01*** | (2006.01) |
| ***B21C 29/00*** | (2006.01) |
| ***C22C 21/00*** | (2006.01) |
| ***C22F 1/04*** | (2006.01) |

(52) U.S. Cl.

CPC ..... *B21C 23/002* (2013.01); *B21C 23/01* (2013.01); *B21C 29/003* (2013.01); *C22C 21/00* (2013.01); *C22F 1/04* (2013.01)

(58) Field of Classification Search

CPC ..... B21C 23/002; B21C 23/04; B21C 23/08; B21C 23/085; B21C 23/14; B21C 23/21; B21C 23/212; B21C 23/01

See application file for complete search history.

(56) References Cited

U.S. PATENT DOCUMENTS 6,299,706 B1 * 10/2001 Miyake ..... C22F 1/047 148/415
2020/0316663 A1 * 10/2020 Hosoi ..... C22C 21/00

FOREIGN PATENT DOCUMENTS

JP H0557387 A * 3/1993 ..... B21C 23/142
JP 2013-23753 A 2/2013
WO WO 2015/182748 A1 12/2015

OTHER PUBLICATIONS

International Search Report issued Aug. 31, 2021 in PCT/JP2021/028775, filed on Aug. 3, 2021, 2 pages.

* cited by examiner

*Primary Examiner* — Debra M Sullivan
(74) *Attorney, Agent, or Firm* — Oblon, McClelland, Maier & Neustadt, L.L.P.

(57) ABSTRACT

A method for manufacturing an aluminum alloy extruded part includes: hot-extruding a 7000 series aluminum alloy by an extruder to form an extruded material; cutting the extruded material extruded from the extruder and moving forward to a predetermined length; applying plastic working to the cut extruded material in a state in which Vickers hardness of the extruded material is 50 to 70 (Hv); and applying aging treatment to the extruded material after the plastic working.

16 Claims, 4 Drawing Sheets

METHOD AND APPARATUS FOR MANUFACTURING ALUMINUM ALLOY EXTRUDED PART

CROSS-REFERENCE TO RELATED APPLICATIONS

This is a national phase application in the United States of International Patent Application No. PCT/JP2021/028775 with an international filing date of Aug. 3, 2021, which claims priority of Japanese Patent Application No. 2020-148473 filed on Sep. 3, 2020 the contents of which are incorporated herein by reference.

TECHNICAL FIELD

The present invention relates to a method and an apparatus for manufacturing an aluminum alloy extruded part.

BACKGROUND ART

An aluminum alloy extruded material may be used as a material of an automobile part such as a bumper reinforcement. An automobile part such as a bumper reinforcement may be formed by subjecting an extruded material to plastic working such as bending or crushing due to design restrictions such as appearance design and collision safety performance.

After extruded from the extruder, the extruded material has natural aging progressed with a lapse of time, the strength increased, and the elongation decreased. Therefore, when the extruded material in which natural aging has progressed to some extent is subjected to plastic working such as bending or crushing, a breakage or a break may occur in the extruded material. JP 2013-23753 A discloses a method for canceling curing due to natural aging and suppressing a breakage or a break by subjecting an extruded material before plastic working to softening heat treatment.

In the method of JP 2013-23753 A, since it is necessary to heat the extruded material before plastic working, problems such as investment in heat treatment equipment and an increase in man-hours occur. Therefore, there is a demand for a method for suppressing a breakage or a break during plastic working at a lower cost and easily.

The present invention has an object to suppress a breakage or a break during plastic working at a low cost and easily as compared with a case of subjecting an extruded material to softening heat treatment in a method and an apparatus for manufacturing an aluminum alloy extruded part.

A first aspect of the present invention provides a method for manufacturing an aluminum alloy extruded part, the method including: hot-extruding a 7000 series aluminum alloy by an extruder to form an extruded material; cutting the extruded material extruded from the extruder and moving forward to a predetermined length; applying plastic working to the cut extruded material in a state in which Vickers hardness of the cut extruded material is 50 Hv or higher and 70 Hv or lower; and applying aging treatment to the extruded material after the plastic working.

According to this method, before natural aging of the extruded material completely progresses, that is, in a state where the extruded material maintains low yield strength and high elongation, the extruded material can be subjected to plastic working. The inventors conducted various experiments, and confirmed that in a state where the Vickers hardness of the extruded material is 50 to 70 (Hv), breakages or breaks during plastic working can be suppressed. Therefore, by applying plastic working in a state of Vickers hardness in this range, it is possible to easily suppress breakages or breaks during plastic working at low cost even without applying softening heat treatment to the extruded material before plastic working. In particular, a high-strength 7000 series aluminum alloy often causes problems of breakages or breaks during plastic working, and can be efficiently formed by the above method.

A time T from the extrusion of the extruded material from the extruder to completion of the plastic working may be set within a range of a following formula (1) in relation to a yield strength σ of the extruded material.

[Mathematical 1]

$$T \leq -0.59\sigma + 322 \quad (1)$$

According to this method, the time from the extrusion of the extruded material from the extruder to the completion of plastic working can be suitably set for each type (yield strength) of the extruded material. The inventors conducted various experiments to confirm the relationship between the type (yield strength) of the extruded material and the time at which breakages or breaks occur. Then, based on the results of the experiments, the above formula was defined as a range in which breakages or breaks in plastic working can be suppressed. Therefore, by setting the time from when the extruded material is extruded from the extruder to the completion of the plastic working for each type (yield strength) of the extruded material so as to satisfy the above formula, it is possible to further suppress breakages or breaks during the plastic working.

The extruded material may have a hollow shape, and the manufacturing method may further include: inserting a nozzle from a front into an inside of the extruded material that is extruded from the extruder and that moves forward; and injecting a refrigerant from the nozzle to cool the extruded material.

According to this method, by using a nozzle that injects a refrigerant for the extruded material having a hollow shape, it is possible to cool the extruded material not only from the outside but also from the inside, and reduce the overall temperature difference of the extruded material in the cooling process. As a result, deformation of the extruded material due to thermal shrinkage during cooling is suppressed, and the material characteristics after the aging treatment are made uniform. In addition, since the extruded material can be quickly cooled, it is possible to improve the strength after the aging treatment of the high-strength 7000 series aluminum alloy having high quenching sensitivity.

The manufacturing method may further include: clamping front and rear portions of a cutting place at a time of cutting the extruded material; and cooling the cutting place of the extruded material and the front and rear portions of the cutting place.

According to this method, a stable cutting is enabled by clamping the extruded material at the time of cutting. In addition, by cooling the extruded material at the time of cutting the extruded material, the temperature of the extruded material immediately after extrusion usually being at a high temperature can be lowered, and the deformation of the extruded material at the time of cutting can be suppressed.

The manufacturing method may further include tensile-straightening the extruded material in a cold state after cutting the extruded material to the predetermined length and before applying the plastic working.

According to this method, it is possible to suppress variations in dimensions of the extruded material to be subjected to plastic working. Therefore, stable plastic working can be achieved.

A second aspect of the present invention provides an apparatus for manufacturing an aluminum alloy extruded part, the apparatus including: an extruder configured to form an extruded material by hot-extruding a 7000 series aluminum alloy; a cutter configured to cut the extruded material to a predetermined length and separate the extruded material from the extruder; a conveyer configured to convey the extruded material cut to the predetermined length; a plastic working machine configured to apply plastic working to the extruded material conveyed by the conveyer; and a controller configured to control the extruder, the cutter, the conveyer, and the plastic working machine so as to complete the plastic working on the extruded material within a predetermined time after the extrusion of the extruded material from the extruder. The predetermined time T is set within a range of a following formula (2) in relation to a yield strength σ of the extruded material.

[Mathematical 2]

$$T \leq -0.59\sigma + 322 \quad (2)$$

According to this configuration, before natural aging of the extruded material completely progresses, that is, in a state where the extruded material maintains low yield strength and high elongation, the extruded material can be subjected to plastic working. In addition, the time from after the extrusion to the completion of the plastic working can be suitably set for each type (yield strength) of the extruded material. As described above, the above formula is defined based on the result of the experiment. Therefore, by setting the time from after the extrusion to the completion of the plastic working for each type (yield strength) of the extruded material based on the above formula, it is possible to easily suppress breakages or breaks during the plastic working at low cost even without subjecting the extruded material to the softening heat treatment before the plastic working.

The manufacturing apparatus may further include a cooler configured to cool the extruded material extruded from the extruder.

According to this configuration, in order to obtain a desired high strength for the 7000 series aluminum alloy having high quenching sensitivity, it is necessary to perform rapid cooling, and the rapid cooling can be achieved by the cooler.

The cooler may include a nozzle configured to inject a refrigerant. The nozzle may be configured to advance and retreat along an extrusion direction of the extruded material.

According to this configuration, when the extruded material has a hollow shape, it is possible to insert the nozzle into the inside of the extruded material to cool the inside of the extruded material. Therefore, the extruded material can be cooled not only from the outside but also from the inside, and the overall temperature difference of the extruded material in the cooling process can be reduced. As a result, deformation of the extruded material due to thermal shrinkage during cooling is suppressed, the temperature history difference is reduced, and the material characteristics after the aging treatment are made uniform. In addition, since the extruded material can be quickly cooled, it is possible to improve the strength after the aging treatment of the high-strength 7000 series aluminum alloy having high quenching sensitivity.

The cutter may include a cutoff tool and a pair of clamp members configured to grip the extruded material and move forward in synchronization with the cutoff tool.

According to this configuration, a stable cutting is enabled by clamping the extruded material at the time of cutting.

At least one of the cutoff tool and the pair of clamp members may include a cooling mechanism for cooling the extruded material.

According to this configuration, it is possible to cool and cut the extruded material in parallel, to reduce the man-hours, and to omit a space for installing cooling equipment. In addition, by cooling the extruded material at the time of cutting the extruded material, the temperature of the extruded material immediately after extrusion usually being at a high temperature can be lowered, and the deformation of the extruded material at the time of cutting can be suppressed.

The cutter may have a function as a stretcher that grips front and rear ends of the extruded material with the pair of clamp members, widens a distance between the pair of clamp members, and tensile-straightens the extruded material. In addition, the manufacturing apparatus may further include a stretcher configured to tensile-straighten the cut extruded material.

According to these configurations, it is possible to suppress variations in dimensions of the extruded material to be subjected to plastic working. Therefore, stable plastic working can be achieved.

Effect of the Invention

According to the present invention, in a method and an apparatus for manufacturing an aluminum alloy extruded part, since the extruded material is subjected to plastic working before natural aging completely progresses, it is possible to easily suppress breakages or breaks during plastic working at a low cost as compared with a case of subjecting an extruded material to softening heat treatment.

MODE FOR CARRYING OUT THE INVENTION

Hereinafter, an embodiment of the present invention will be described with reference to the accompanying drawings.

Figure 1:
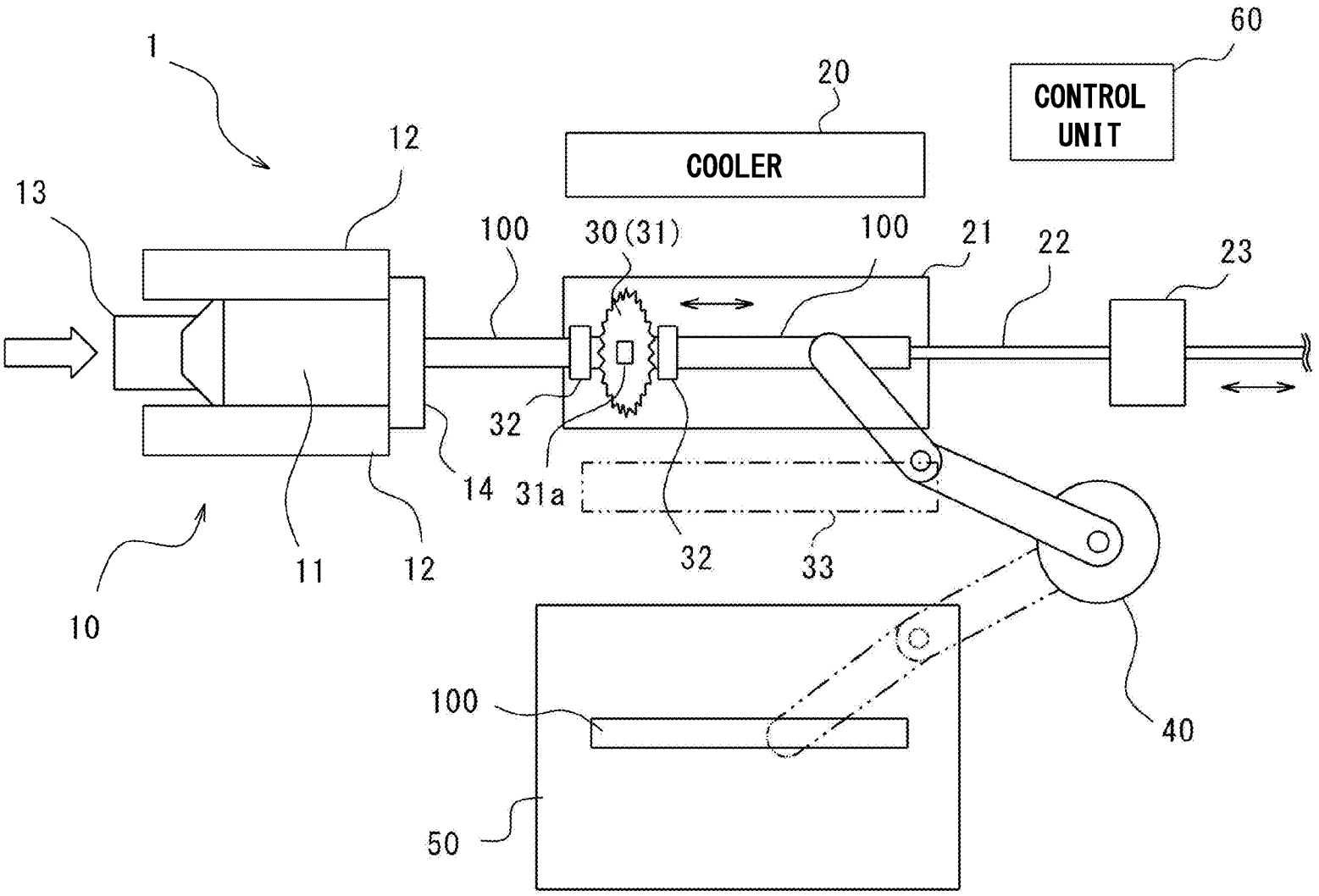
FIG. 1 is a schematic configuration diagram of an apparatus for manufacturing an aluminum alloy extruded part according to an embodiment of the present invention.

Referring to FIG. 1, a manufacturing apparatus 1 for manufacturing an aluminum alloy extruded part according to the present embodiment includes an extruder 10, a cooler 20, a cutter 30, a conveyer 40, a plastic working machine 50, and a controller 60.

In the extruder 10, a billet 11 of an aluminum alloy heated to a temperature at which extruding can be performed is stored in a container 12. Then, a stem 13 is advanced to push the material forward through a die 14. In the present embodiment, a 7000 series aluminum alloy is used as the material. The 7000 series aluminum alloy has high strength and can be suitably used for a collision protective member or a body framework for an automobile.

Preferable examples of the composition of the 7000 series aluminum alloy include a composition containing, for example, Zn: 3 to 8% by mass, Mg: 0.4 to 2.5% by mass, Cu: 0.05 to 2.0% by mass, and Ti: 0.005 to 0.2% by mass, and further containing one or more of Mn: 0.01 to 0.5% by mass, Cr: 0.01 to 0.3% by mass, and Zr: 0.01 to 0.3% by mass, with the balance being Al and impurities.

The cooler 20 forcibly cools the extruded material 100 extruded from the die 14 of the extruder 10 and moving forward on the table 21. The cooler 20 may be, for example, a fan air cooling apparatus or a water cooling apparatus. The cooler 20 includes a nozzle 22 that injects a refrigerant. The nozzle 22 is supported by a support mechanism 23 and can advance and retreat back and forth along the extrusion direction. The nozzle 22 is fluidly connected to a refrigerant supply mechanism (not shown). It should be noted that when the extruded material 100 can be sufficiently quenched only by natural air cooling, the cooler 20 does not need to be installed. In addition, when the extruded material 100 can be sufficiently quenched only by the fan air cooling apparatus or the water cooling apparatus, the nozzle 22 does not need to be installed.

The nozzle 22 can be suitably used when the extruded material 100 has a hollow shape (for example, a cylindrical shape). More suitably, it can be used when the extruded material 100 has one or more inner ribs. In the present embodiment, the extruded material 100 has, for example, a hollow rectangular shape in a cross section perpendicular to the extrusion direction (that is, the front-back direction). The nozzle 22 is inserted from the front into the extruded material 100 that is extruded from the die 14 of the extruder 10 and moves forward. Then, the refrigerant is injected into the extruded material 100 through the nozzle 22. After the extruded material 100 is cooled from the inside, the nozzle 22 is extracted from the extruded material 100. In order to more uniformly cool the extruded material 100, the nozzle 22 may be moved back and forth while injecting the refrigerant, to be removed and inserted from and into the extruded material 100.

The cutter 30 includes a cutoff tool 31 (circular saw in the present embodiment) and a pair of clamp members 32 and 32. In addition, the cutter 30 includes a drive mechanism that operates the cutoff tool 31, a drive mechanism that operates the clamp members 32 and 32, and an advancing and retreating mechanism that moves the cutoff tool 31 and the clamp members 32 and 32 forward or backward along the extrusion direction. It should be noted that none of the mechanisms are illustrated. The cutoff tool 31, the clamp members 32 and 32, and other mechanisms are installed on, for example, the table 21.

The clamp members 32 and 32 are disposed adjacent to each other so as to sandwich the cutoff tool 31 in the front-back direction. The clamp members 32 and 32 grip the front and rear positions of the cutting place of the extruded material 100 extruded from the die 14 and moved forward (gripping place), and position the extruded material 17 with respect to the cutoff tool 31. The clamp members 32 and 32 gripping the cutoff tool 31 and the extruded material 100 move forward at the same speed as the extrusion speed of the extruder 10 (that is, the moving speed of the extruded material 100). Then, in the process, the cutoff tool 31 operates to cut the extruded material 100. The cutting place is set at a position where the length of the extruded material 100 after cutting is a predetermined length. The predetermined length is substantially the same as the length of the aluminum alloy extruded part to be finally obtained. Here, the substantially same length includes a length to such an extent that a portion gripped by the clamp members 32 and 32 can be further cut and removed in order to eliminate a clamping scratch that may occur in a portion gripped by the clamp members 32 and 32.

The clamp members 32 and 32 are set to grip the extruded material 100 at a position immediately after the extrusion (for example, about 0.5 to 1.5 m forward from the die 14 of the extruder 10). Therefore, there is a strong possibility that the cutting place and the gripping place are in a high temperature state when the clamp members 32 and 32 grip the extruded material 100. In order to prevent the extruded material 100 softened at a high temperature from being deformed at the time of cutting, preferably, at least one of the clamp members 32 and 32 and the cutoff tool 31 includes a cooling mechanism that cools the cutting place and the gripping place of the extruded material 100. In the illustrated example, the cutoff tool 31 is provided with a cooling mechanism 31*a* for air cooling or water cooling. It should be noted that the cooling of the extruded material 100 is performed in parallel with the cutting of the extruded material 100.

The cutter 30 can function as a stretcher of the extruded material 100 after cutting and cooling, as needed. That is, the cutter 30 can function as a stretcher that grips the front and rear ends of the extruded material 100 with the pair of clamp members 32 and 32, widens the interval between the pair of clamp members 32 and 32, and tensile-straightens the extruded material 100. Instead of or addition to this, a dedicated stretcher 33 may be arranged near the cutter 30 and tensile-straighten the extruded material 100 after cutting. It should be noted that when tensile-bending is performed in the plastic working machine 50 described below, since the extruded material 100 is subjected to tensile-straightening in the process of tensile-bending, prior tensile-straightening by the clamp members 32 and 32 or the stretcher 33 is unnecessary.

As described above, by cutting the extruded material 100 immediately after the extrusion to a predetermined length (at most 5 m or less) and performing cooling and cutting in parallel, a conventional huge table having a length of about 30 to 50 mm in the front-back direction is unnecessary. The length in the front-back direction of the table 21 in the present embodiment shown in FIG. 1 is sufficient to be 10 m or less. In addition, since the extruded material 100 after cutting is short (at most 5 m or less), the floor area of the manufacturing apparatus 1 can be reduced even if the conveyer 40 and the plastic working machine 50 are included.

The conveyer 40 grips the cut extruded material 100 and conveys the extruded material 100 toward the plastic working machine 50. As described above, since the extruded material 100 is generally short, for example, a robot arm may be used. Also from this point, the floor area of the manufacturing apparatus 1 can be reduced.

The plastic working machine 50 subjects the extruded material 100 to one or more kinds of plastic working of bending, crushing, shearing (for example, punching), burring, swaging, and other press forming in a cold state. A press mechanism required in the plastic working machine 50 is arranged corresponding to the type of plastic working to be applied to the extruded material 100. For example, when the aluminum alloy extruded part is a bumper reinforcement, both end portions of the extruded material 100 are subjected to bending, and then a part in the longitudinal direction is subjected to crushing, the plastic working machine 50 includes a bending press mechanism and a crushing press mechanism.

The extruded material 100 made of a 7000 series aluminum alloy starts natural aging immediately after cooling, and yield strength gradually increases with a lapse of time. However, in the present embodiment, the plastic working is completed before the natural aging of the extruded material 100 completely progresses. That is, the extruded material 100 is subjected to plastic working in a state where the extruded material 100 maintains low yield strength and high elongation. Specifically, plastic working is applied in a state where the Vickers hardness of the extruded material 100 is 50 to 70 (Hv). This numerical range is based on the following experimental results.

Figure 2:
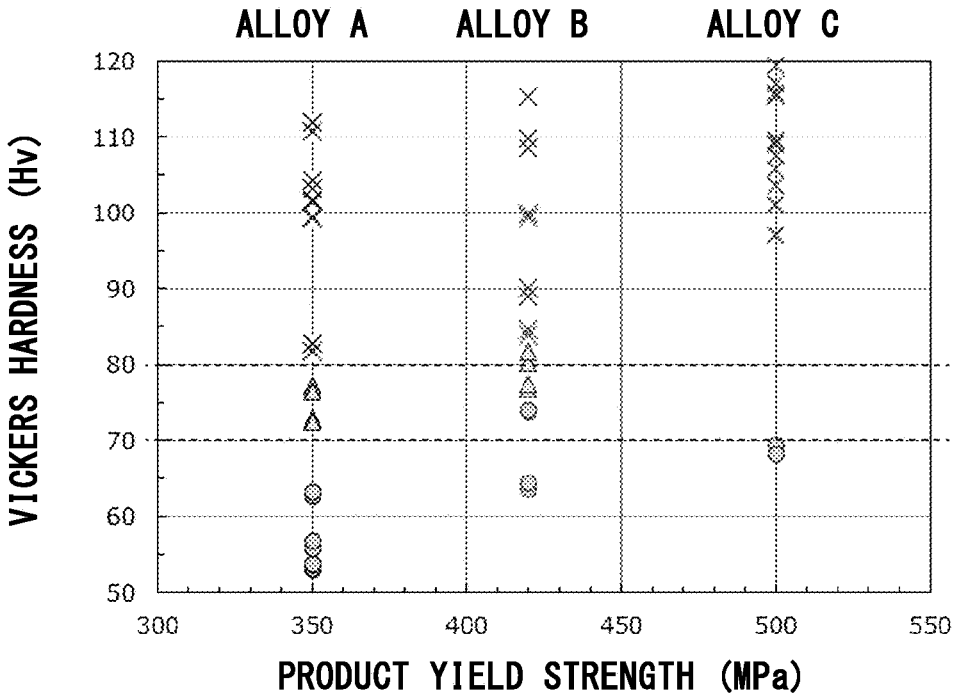
FIG. 2 is a graph showing a relationship between the Vickers hardness (Hv) and the appearance break by the crushing test for three types of alloys A to C having different product yield strengths (MPa)

FIG. 2 is a graph showing experimental results. The horizontal axis of the graph represents the product yield strength (MPa). The vertical axis of the graph represents the Vickers hardness (Hv). The graph shows a relationship between the Vickers hardness (Hv) and the appearance break by the crushing test for three types of alloys A to C having different product yield strengths (MPa). The alloy A is an alloy having a product yield strength of 350 (MPa), the alloy B is an alloy having a product yield strength of 420 (MPa), and the alloy C is an alloy having a product yield strength of 500 (MPa).

Figure 3:
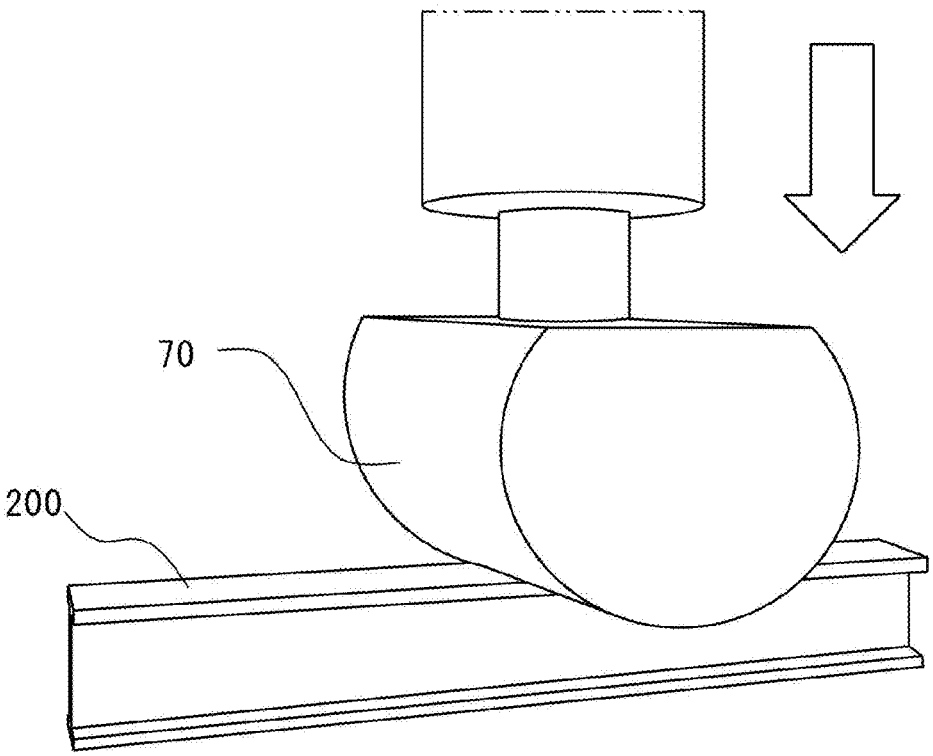
FIG. 3 is a perspective view showing a crushing test apparatus.

Referring to FIG. 3, test bodies (extruded materials) 200 of the alloys A to C were subjected to a plurality of crushing test for each Vickers hardness (for each degree of natural aging). In the crushing test, the test body 200 was crushed by moving a jig 70 having a diameter of 100 mm at a speed of 50 mm per minute. The test body 200 was extruded from the extruder 10 (see FIG. 1) and then cut so as to have a length of 300 mm or more. Water cooling was applied when the elapsed time after extrusion was 30 minutes or less, and fan air cooling was applied when the elapsed time after extrusion exceeded 30 minutes.

Referring again to FIG. 2, as test results, circles (○) in the graph indicate that neither a crack nor a break occurred in the test body 200, triangles (Δ) indicate that breaks did not occur but cracks occurred, and crosses (x) indicate that breaks occurred.

In the test body 200 of the alloy A, neither a crack nor a break was generated until the Vickers hardness was about 63 (Hv), cracks were generated when the Vickers hardness was about 72 to 78 (Hv), and breaks were generated when the Vickers hardness was about 82 (Hv) or more. In the test body of the alloy B, neither a crack nor a break was generated until the Vickers hardness was about 73 (Hv), cracks were generated when the Vickers hardness was about 76 to 80 (Hv), and breaks were generated when the Vickers hardness was about 84 (Hv) or more. In the test body 200 of the alloy C, neither a crack nor a break was generated until the Vickers hardness was about 70 (Hv), and breaks were generated when the Vickers hardness was about 97 (Hv) or more.

In general, when the Vickers hardness was 80 (Hv) or less, no break was generated in all the alloys. Furthermore, when the Vickers hardness was 70 (Hv) or less, neither a crack nor a break was generated in all the alloys. Therefore, the plastic working is preferably applied with a Vickers hardness of 80 (Hv) or less, and more preferably applied with a Vickers hardness of 70 (Hv) or less. In the range of the experiment, the Vickers hardness of the 7000 series aluminum alloy was 50 (Hv) or more. Therefore, in the present embodiment, plastic working is applied in a state where the Vickers hardness of the extruded material is 50 to 70 (Hv) to suppress breakages and breaks of the extruded material.

It is known that the Vickers hardness of the extruded material of the 7000 series aluminum alloy is correlated with each of the tensile strength and the yield strength. However, a specific numerical value related to the correlation is not generally known, and the inventors of the present application confirmed the numerical value related to the correlation as follows. Specifically, as numerical values related to the correlation, the tensile strength (MPa) corresponds to 3.8 times the Vickers hardness (Hv), and the yield strength (MPa) corresponds to 2.5 times the Vickers hardness (Hv). Therefore, the state where the Vickers hardness is 50 to 70 (Hv) corresponds to the state where the tensile strength is 190 to 266 (MPa). In addition, the state where the Vickers hardness is 50 to 70 (Hv) corresponds to the state where the yield strength is 125 to 175 (MPa). Therefore, instead of the Vickers hardness, the state of the extruded material to be subjected to plastic working may be similarly defined by tensile strength or yield strength.

Figure 4:
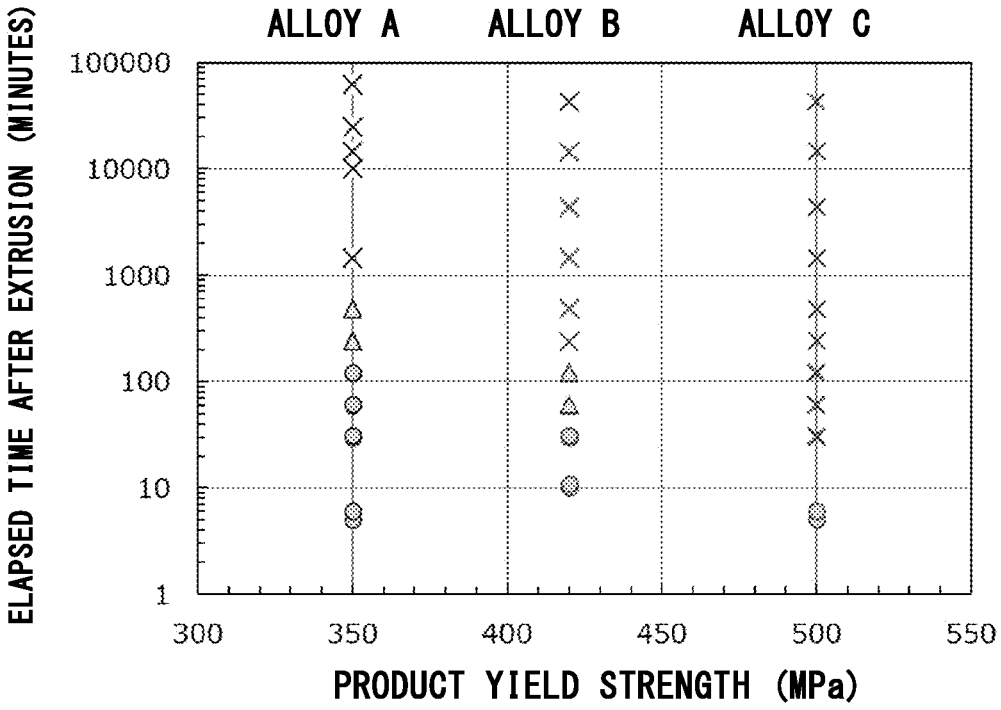
FIG. 4 is a graph showing the relationship between the elapsed time (minutes) from after the extrusion to the completion of the crushing and the appearance breaks due to the crushing test, for three types of alloys A to C having different product yield strengths (MPa)

FIG. 4 is a graph showing the result of the crushing test in FIG. 2 with respect to the elapsed time from after the extrusion to the completion of the crushing. The horizontal axis of the graph represents the product yield strength (MPa) as in FIG. 2. The vertical axis of the graph represents the elapsed time (minutes) from after the extrusion to the completion of the crushing.

In the test body 200 of the alloy A, neither a crack nor a break occurred until the elapsed time was about 120 minutes, cracks occurred when the elapsed time was about 240 to 480 minutes, and breaks occurred when the elapsed time was about 1440 minutes or more. In the test body of the alloy B, neither a crack nor a break occurred until the elapsed time was about 30 minutes, cracks occurred when the elapsed time was about 60 to 120 minutes, and breaks occurred when the elapsed time was about 240 minutes or more. In the test body 200 of the alloy C, neither a crack nor a break occurred until the elapsed time was about 5 minutes, and breaks occurred when the elapsed time was about 30 minutes or more.

In general, when crushing was performed within 5 minutes after extrusion, neither a crack nor a break was generated in all the alloys. Therefore, the plastic working is preferably applied within 5 minutes after extrusion. In addition, regarding the alloys A to C, it was confirmed that there are large differences as described above in the elapsed time until cracks or breaks occur. Therefore, it is preferable to appropriately set the elapsed time to the completion of the crushing from after the extrusion for each type of the alloys A to C as follows.

Figure 5:
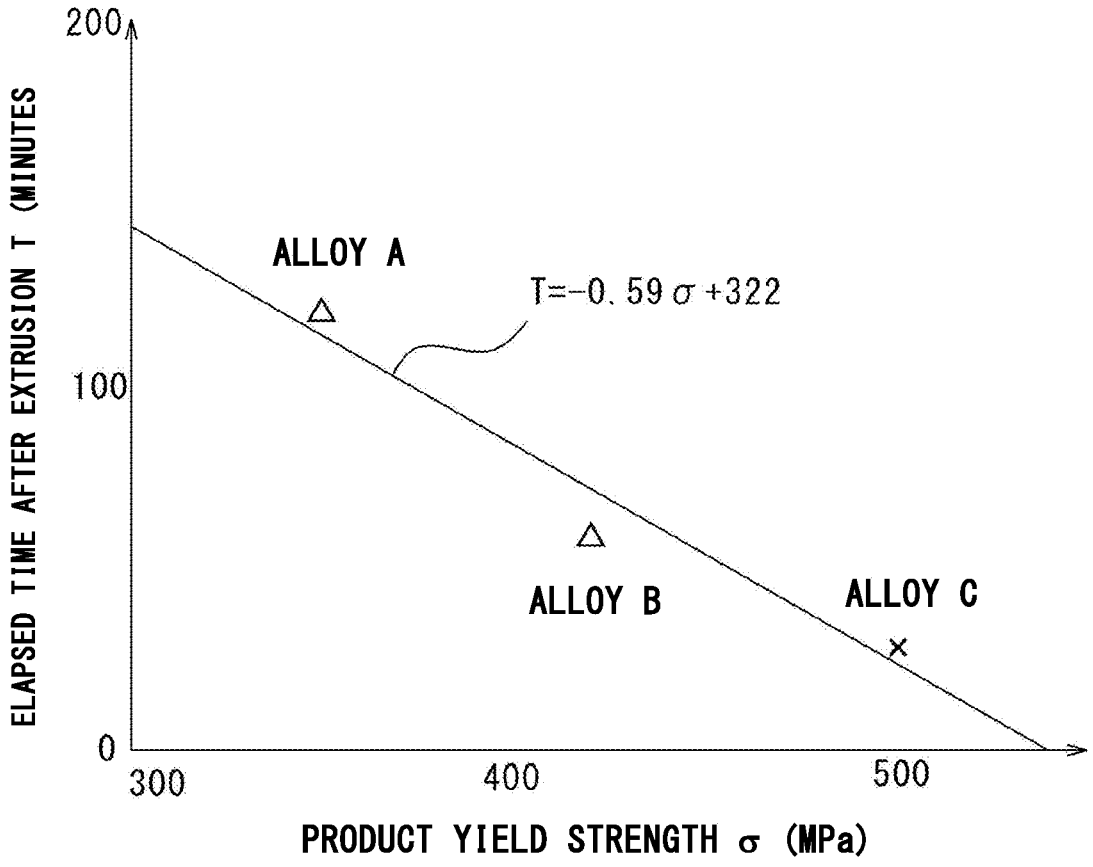
FIG. 5 is a graph showing a part of FIG. 4.

FIG. 5 is a graph obtained by plotting points at which cracks or breaks occurred first for each of the alloys A to C in the graph in FIG. 4. The data for the plotted points are: Alloy A ($T=120$, $\sigma=350$); Alloy B ($T=60$, $\sigma=420$); and Alloy C ($T=30$, $\sigma=500$). In FIG. 5, the three plotted points are linearly approximated by the least squares method. Accordingly, the elapsed time (T) to the completion of the crushing from after the extrusion can be appropriately set for each type of alloy (yield strength σ) as in the following formula (3), where the elapsed time is T (min) and the product yield strength is σ (MPa).

[Mathematical 3]

$$T \leq -0.59\sigma + 322 \quad (3)$$

Referring again to FIG. 1, the controller 60 includes hardware such as a central processing unit (CPU), a random access memory (RAM), and a read only memory (ROM), and software implemented on the hardware. The controller 60 controls the extruder 10, the cutter 30, the conveyer 40, and the plastic working machine 50 so that the plastic working on the extruded material 100 is completed within a predetermined time T after the extruded material 100 is extruded from the extruder 10. Preferably, the predetermined time T is set to a time satisfying the above formula (3).

After the plastic working, an aluminum alloy extruded part is completed by subjecting the extruded material 100 to the artificial aging treatment. The artificial aging treatment may be performed in units of lots using a heating furnace as in the conventional case. The heating furnace may be installed on the same floor as a part of the manufacturing apparatus 1, or may be installed at another appropriate place.

The aluminum alloy extruded part manufactured according to the present embodiment is suitably used for a collision protective member (energy absorbing member) and a body framework of a passenger car, a light automobile, a truck, or the like. Examples of the collision protective member part include a bumper reinforcement, a door beam, a crash box (bumper stay), a stay integrated bumper reinforcement, a pedestrian leg protective part, and an underrun protector. Examples of the body framework part include front and rear side members, a radiator support, a front upper member, a roof rail, front and rear headers, a rocker, and a floor cross member. In addition, the aluminum alloy extruded part manufactured according to the present embodiment is also suitably used for a body framework of a motorcycle and a bicycle.

According to the present embodiment, before natural aging of the extruded material 100 completely progresses, that is, in a state where the extruded material 100 maintains low yield strength and high elongation, the extruded material 100 can be subjected to plastic working. In addition, based on the above formula (3), the time from after the extrusion to the completion of the plastic working can be suitably set for each type (yield strength) of the extruded material 100. As described above, the above formula (3) is defined based on the result of the experiment. Therefore, by setting the time from after the extrusion to the completion of the plastic working for each type (yield strength) of the extruded material based on the above formula (3), it is possible to easily suppress breakages or breaks during the plastic working at low cost even without subjecting the extruded material 100 to the softening heat treatment before the plastic working.

In addition, in order to obtain a desired high strength for the 7000 series aluminum alloy having high quenching sensitivity, it is necessary to perform rapid cooling, and the rapid cooling can be achieved by the cooler 20.

In addition, the inside of the extruded material 100 can be cooled by inserting the nozzle 22 into the hollow-shaped extruded material 100 and injecting the refrigerant. Therefore, the extruded material 100 can be cooled not only from the outside but also from the inside, and the overall temperature difference of the extruded material 100 in the cooling process can be reduced. As a result, deformation of the extruded material 100 due to thermal shrinkage during cooling is suppressed, and the material characteristics after the aging treatment are made uniform. In addition, since the extruded material 100 can be quickly cooled, it is possible to improve the strength after the aging treatment of the high-strength 7000 series aluminum alloy having high quenching sensitivity.

In addition, by clamping the extruded material 100 at the time of cutting by the clamp members 32 and 32, stable cutting is enabled.

In addition, since the cutoff tool 31 includes the cooling mechanism 31*a* that cools the cutting place and the gripping place of the extruded material 100, it is possible to cool and cut the extruded material 100 in parallel, to reduce the man-hours, and to omit a space for installing cooling equipment. In addition, by cooling the extruded material 100 at the time of cutting the extruded material 100, the temperature of the extruded material 100 immediately after extrusion usually being at a high temperature can be lowered, and the deformation of the extruded material 100 at the time of cutting can be suppressed.

In addition, since the tensile straightening can be performed before the plastic working by at least one of the clamp members 32 and 32 and the stretcher 33, it is possible to suppress variations in the dimensions of the extruded material 100 to be subjected to the plastic working. Therefore, stable plastic working can be achieved.

As described above, although the specific embodiment of the present invention is described, the present invention is not limited to the above-described embodiment, and can be implemented with various modifications within the scope of the present invention.

The invention claimed is:

1. A method for manufacturing an aluminum alloy extruded part, the method comprising:

hot-extruding a 7000 series aluminum alloy by an extruder to form an extruded material;

cutting the extruded material as it moves forward from the extruder to a predetermined length;

applying plastic working to the cut extruded material in a state in which Vickers hardness of the cut extruded material is 50 Hv or higher and 70 Hv or lower; and applying aging treatment to the extruded material after the plastic working, wherein a time T minute(s) from the extrusion of the extruded material from the extruder to completion of the plastic working is set within a range of a following formula in relation to a yield strength σ MPa of the extruded material:

$$T \leq -0.59\sigma + 322.$$

2. The method for manufacturing an aluminum alloy extruded part according to claim 1, wherein the extruded material has a hollow shape, the method further comprising:

inserting a nozzle from a front into an inside of the extruded material that is extruded from the extruder and that moves forward; and injecting a refrigerant from the nozzle to cool the extruded material.

3. The method for manufacturing an aluminum alloy extruded part according to claim 1, further comprising:

clamping front and rear portions of a cutting place at a time of cutting the extruded material; and cooling the cutting place of the extruded material and the clamped front and rear portions of the cutting place.

4. The method for manufacturing an aluminum alloy extruded part according to claim 3, further comprising tensile-straightening the extruded material in a cold state after cutting the extruded material to the predetermined length and before applying the plastic working.

5. The method for manufacturing an aluminum alloy extruded part according to claim 1, further comprising tensile-straightening the extruded material in a cold state after cutting the extruded material to the predetermined length and before applying the plastic working.

6. The method for manufacturing an aluminum alloy extruded part according to claim 5, further comprising stretching with a stretcher to provide the tensile-straighten of the cut extruded material.

7. An apparatus for manufacturing an aluminum alloy extruded part, the apparatus comprising:

an extruder configured to form an extruded material by hot-extruding a 7000 series aluminum alloy;

a cutter configured to cut the extruded material to a predetermined length and separate the extruded material from the extruder;

a conveyer configured to convey the extruded material cut to the predetermined length;

a plastic working machine configured to apply plastic working to the extruded material conveyed by the conveyer; and a controller configured to control the extruder, the cutter, the conveyer, and the plastic working machine so as to complete the plastic working on the extruded material within a predetermined time after the extrusion of the extruded material from the extruder, wherein the predetermined time T minute(s) is set within a range of a following formula in relation to a yield strength σ MPa of the extruded material $$T \leq -0.59\sigma + 322.$$

8. The apparatus for manufacturing an aluminum alloy extruded part according to claim 7, further comprising a cooler configured to cool the extruded material extruded from the extruder.

9. The apparatus for manufacturing an aluminum alloy extruded part according to claim 8, wherein the cooler includes a nozzle configured to inject a refrigerant, and wherein the nozzle is configured to advance and retreat along an extrusion direction of the extruded material.

10. The apparatus for manufacturing an aluminum alloy extruded part according to claim 7, wherein the cutter includes a cutoff tool and a pair of clamps configured to grip the extruded material and move forward in synchronization with the cutoff tool.

11. The apparatus for manufacturing an aluminum alloy extruded part according to claim 10, wherein at least one of the cutoff tool and the pair of clamps includes a cooler to cool the extruded material.

12. The apparatus for manufacturing an aluminum alloy extruded part according to claim 11, wherein the cutter has a function as a stretcher that grips front and rear ends of the extruded material with the pair of clamp members, widens a distance between the pair of clamp members, and tensile-straightens the extruded material.

13. The apparatus for manufacturing an aluminum alloy extruded part according to claim 11, further comprising a stretcher configured to tensile- straighten the cut extruded material.

14. The apparatus for manufacturing an aluminum alloy extruded part according to claim 10, wherein the cutter has a function as a stretcher that grips front and rear ends of the extruded material with the pair of clamps, widens a distance between the pair of clamps, and tensile-straightens the extruded material.

15. The apparatus for manufacturing an aluminum alloy extruded part according to claim 10, further comprising a stretcher configured to tensile- straighten the cut extruded material.

16. The apparatus for manufacturing an aluminum alloy extruded part according to claim 7, further comprising a stretcher configured to tensile- straighten the cut extruded material.

* * * * *